US012402720B2

(12) United States Patent
Bellas et al.

(10) Patent No.: US 12,402,720 B2
(45) **Date of Patent: *Sep. 2, 2025**

(54) LAP DESK

(71) Applicants: Constantinos Dean Bellas, White Plains, NY (US); John Albin Tavolacci, Irvington, NY (US)

(72) Inventors: Constantinos Dean Bellas, White Plains, NY (US); John Albin Tavolacci, Irvington, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/952,189

(22) Filed: Nov. 19, 2024

(65) Prior Publication Data

US 2025/0072598 A1 Mar. 6, 2025

Related U.S. Application Data

(63) Continuation of application No. 18/234,416, filed on Aug. 16, 2023.

(60) Provisional application No. 63/371,938, filed on Aug. 19, 2022.

(51) Int. Cl.
*A47B 23/00* (2006.01)
*A47B 13/16* (2006.01)

(52) U.S. Cl.
CPC ..... *A47B 23/002* (2013.01); *A47B 13/16* (2013.01)

(58) Field of Classification Search
CPC ..... A47B 23/041; A47B 23/002; A47B 13/16
USPC ..... 108/43
See application file for complete search history.

(56) References Cited

U.S. PATENT DOCUMENTS 4,235,472 A * 11/1980 Sparks ..... A47C 7/383 5/639
4,700,634 A * 10/1987 Mills ..... B43L 13/005 248/444
4,790,041 A * 12/1988 Shtull ..... A47D 15/003 5/655
4,938,439 A * 7/1990 Fried ..... B60N 2/787 248/444
4,991,908 A * 2/1991 Krechel ..... A47C 16/02 D6/349
5,081,936 A * 1/1992 Drieling ..... B60N 3/002 108/43
5,127,339 A * 7/1992 Hood, Jr. ..... A47G 23/0608 108/42
D342,170 S * 12/1993 Palmer ..... D12/419
5,520,119 A * 5/1996 Eisenberg ..... A47B 23/002 108/43
D383,918 S * 9/1997 Prince ..... D6/406.3
5,732,849 A * 3/1998 Brooks ..... A47B 23/002 220/17.1
5,732,910 A * 3/1998 Martin ..... A47B 21/0314 248/118
5,765,790 A * 6/1998 Kuldvere ..... G06F 3/0395 248/118
5,829,729 A * 11/1998 Welch ..... A47B 23/044 248/459
5,862,933 A * 1/1999 Neville ..... B60N 3/002 220/17.1

(Continued)

*Primary Examiner* — Jose V Chen
(74) *Attorney, Agent, or Firm* — Leason Ellis LLP

(57) ABSTRACT

A lap desk can be formed as a single body of material, such as foam. The body includes a main rear section having a top planar surface and left and right arms that extend forwardly from the main rear section and have top surfaces for supporting arms of a user.

20 Claims, 7 Drawing Sheets

(56) References Cited

U.S. PATENT DOCUMENTS

D411,388 S * 6/1999 Sacco ..... D6/406.3
6,061,854 A * 5/2000 Crowley ..... A47D 13/083 5/640
6,173,656 B1 * 1/2001 Blanchard ..... A47B 23/002 108/43
6,374,751 B1 * 4/2002 With ..... G06F 3/0395 100/90
6,529,369 B1 * 3/2003 Zarek ..... G06F 1/1624 361/679.55
6,659,545 B1 * 12/2003 McMillan ..... A47D 3/00 297/188.2
6,986,308 B1 * 1/2006 King ..... A47G 23/0608 108/43
D526,810 S * 8/2006 Lorr ..... D6/406.5
7,249,747 B2 * 7/2007 Marceau ..... A47B 23/002 248/346.07
7,992,502 B1 * 8/2011 Davis ..... A47B 23/04 248/444
D661,125 S * 6/2012 Francis ..... D6/406.3
9,486,072 B1 * 11/2016 Chapman ..... A01K 1/0353
9,578,960 B1 * 2/2017 Wu ..... A47B 21/0314
9,582,086 B2 * 2/2017 Schweiter, Jr. ..... G06F 3/039
D794,974 S * 8/2017 Jennings ..... D6/406.3
9,999,298 B1 * 6/2018 Sullins ..... A47B 13/16
10,362,852 B2 * 7/2019 Halloway ..... A45D 29/22
D887,166 S * 6/2020 Ren ..... D6/406.5
D913,720 S * 3/2021 Zhang ..... D6/406.6
11,812,854 B2 * 11/2023 Blackowiak ..... A47C 27/142
2003/0230220 A1 * 12/2003 Evans ..... A47B 23/00 108/43
2004/0250738 A1 * 12/2004 Conlee ..... A47B 23/002 108/43
2004/0261668 A1 * 12/2004 Jarke ..... H01M 4/9066 108/43
2005/0211138 A1 * 9/2005 Gupta ..... A47B 23/002 108/43
2006/0138297 A1 * 6/2006 Esimai ..... A47C 3/16 5/653
2007/0045486 A1 * 3/2007 Stewart ..... A47B 23/002 248/118.1
2010/0307385 A1 * 12/2010 Raney ..... A47B 23/002 108/43
2010/0326330 A1 * 12/2010 Sween ..... A47B 21/04 108/41
2011/0200219 A1 * 8/2011 Vizcarra ..... G06F 1/203 108/43
2012/0060724 A1 * 3/2012 Doss ..... A47B 23/04 108/43
2012/0160136 A1 * 6/2012 Lineal ..... A47B 23/04 108/43
2013/0061781 A1 * 3/2013 Wong ..... A47B 23/04 108/3

* cited by examiner

LAP DESK

CROSS-REFERENCE TO RELATED APPLICATION

The present application is a continuation of U.S. patent application Ser. No. 18/234,416, filed Aug. 16, 2023, which claims the benefit of and priority to U.S. patent application Ser. No. 63/371,938, filed Aug. 19, 2022, which is hereby incorporated by reference in its entirety.

TECHNICAL FIELD

The present disclosure is directed to furniture and accessories and more particularly, to a lap desk that is designed as a desk or support surface set in the lap.

BACKGROUND

There are many types of support and work surfaces with one common product being a desk. Likewise, there are many types of desk, including traditional desks, motorized desks that can be raised and lowered and portable desk including lap desks that provide a support or work surface that is set in the lap or positioned across the lap.

While there are many different types of lap desks on the market, they suffer from different deficiencies that make their use less than ideal. For example, traditional lap desks are typically constructed as a substrate, often rectangular or oval, on which objects, like notes or a laptop can be placed. However, these products can be uncomfortable to the user as these products lack arm and elbow support. To compensate for this deficiencies, a user can prop up pillows for makeshift armrests and a desk surface, but these makeshift creations are uncomfortable and unreliable and not a long term solution.

SUMMARY

A lap desk is disclosed and can be formed as a single body construction in that it is formed as a single mass. For example, the lap desk can be formed from foam and be in the form of a single contoured block of foam. The body includes a main rear section having a top planar surface and left and right arms that extend forwardly from the main rear section and have top surfaces for supporting arms of a user.

BRIEF DESCRIPTION OF THE DRAWING FIGURES

DETAILED DESCRIPTION OF CERTAIN EMBODIMENTS

FIGS. 1-6 illustrate a lap desk 100 according to one exemplary embodiment. The lap desk 100 is preferably formed as a single block of material. For example, the lap desk 100 can be formed as a contoured foam product that is made from suitable foams using manufacturing techniques, such as injection molding or other mold processes. For example, one type of foam suitable for use is a polyurethane; however, other foams can be used. The single foam block shape of the lap desk 100 provides sufficient rigidity to support objects, such as laptops, etc., while also being comfortable to the arms and elbows of the user. While in one preferred embodiment, the lap desk 100 is formed as a single piece (single formed/manufactured article), it will be appreciated that it can be formed of a plurality of pieces that are combined to form the final product.

Alternatively, the lap desk 100 can be formed of at least two layers of foam material that is attached to one another to form the lap desk. For example, the two or more layers can be bonded to one another.

Figure 1:
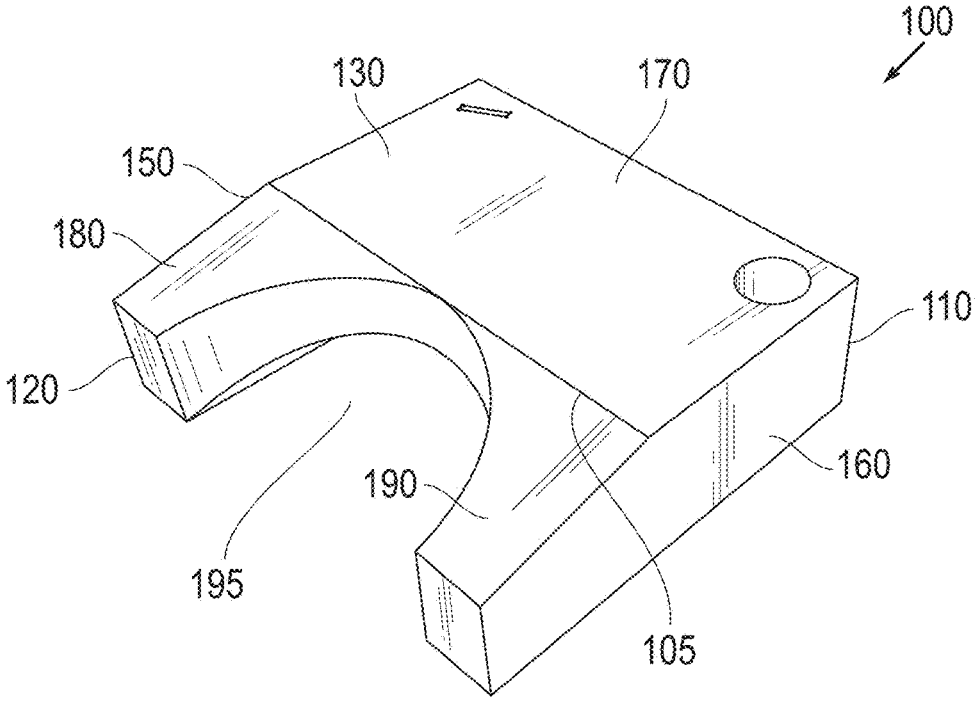
FIG. 1 is a top and side perspective view of an exemplary lap desk in accordance with a first embodiment of the present disclosure.
Figure 2:
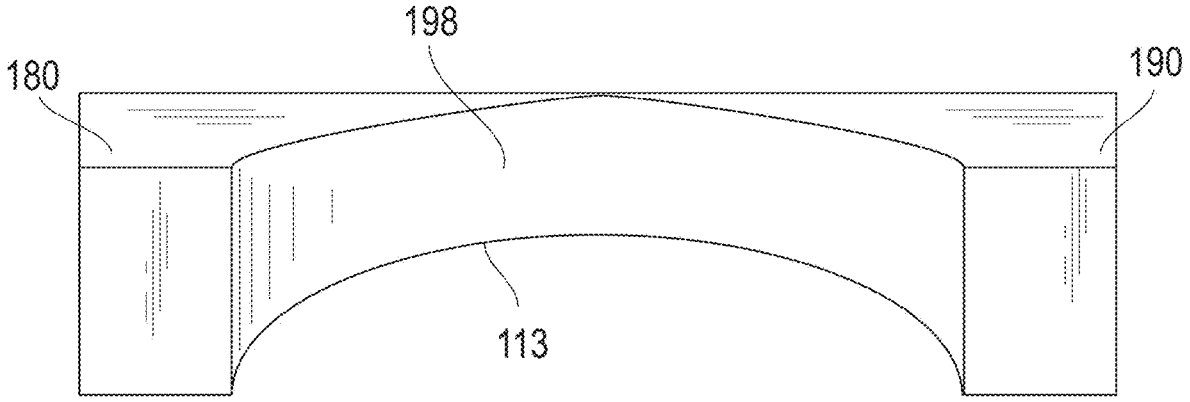
FIG. 2 is a front elevation view thereof.

The lap desk 100 has a rear 110, an opposite front 120, a top 130, an opposite bottom 140, a left side 150 and an opposite right side 160. Generally speaking, and in contrast to conventional lap desks, the lap desk 100 has a main rear section 170 that represents the support and work surface and has a first (left) arm 180 and a second (right) arm 190 that are integral to an extend rearward from the main rear section 170. For purposes of discussion, the first and second arms 180, 190 can be considered to define a front section of the lap desk. In FIG. 1, an artificial line 105 is shown to demarcate the main rear section 170 from the rear section. It will be appreciated that the relative size of the main rear section 170 and front section can vary. In the illustrated embodiment, the main rear section 170 is slightly larger than the front section (in terms of its length in the forward/rearward direction).

Since the top surface (top 130) of the main rear section 170 represents the support or work surface, it is a planar (flat) surface. As described below, the main rear section 170 can include optional accessories.

Figure 3:
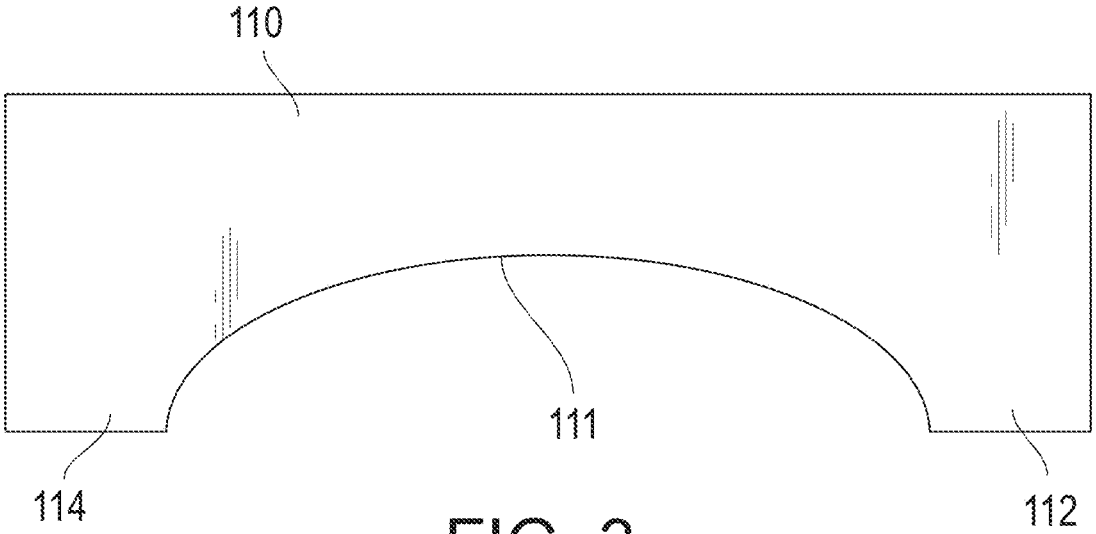
FIG. 3 is a rear elevation view thereof.
Figure 5:
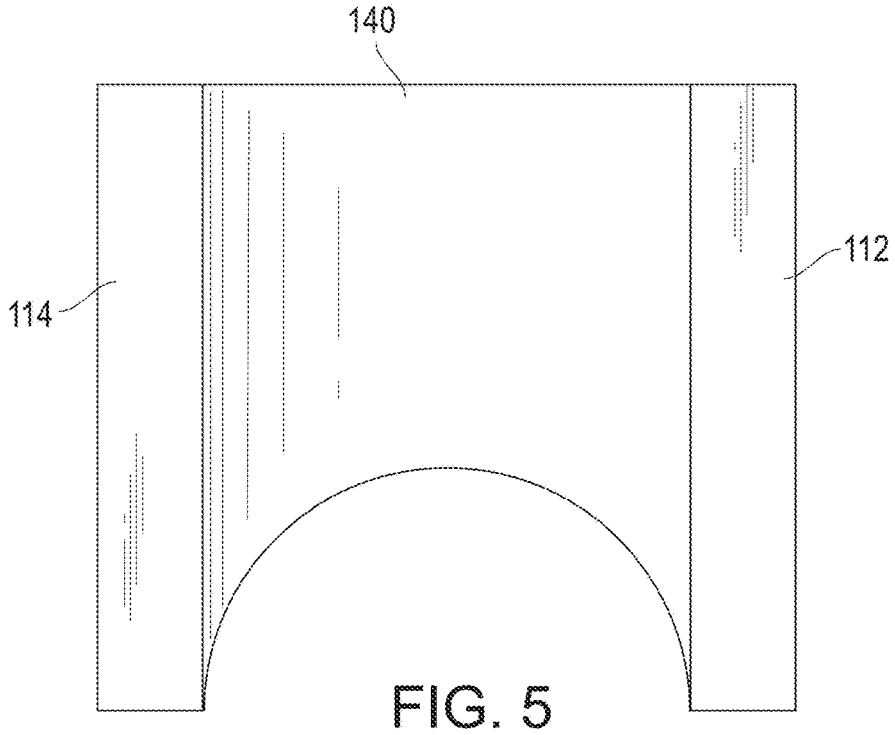
FIG. 5 is a bottom plan view thereof.
Figure 6:
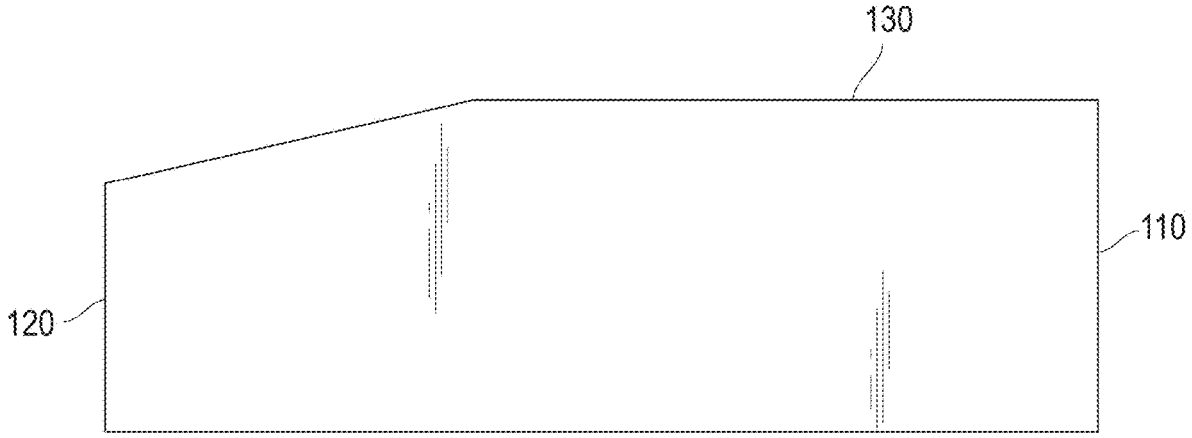
FIG. 6 is a right side elevation view thereof, with the left side being a mirror image.
Figure 7:
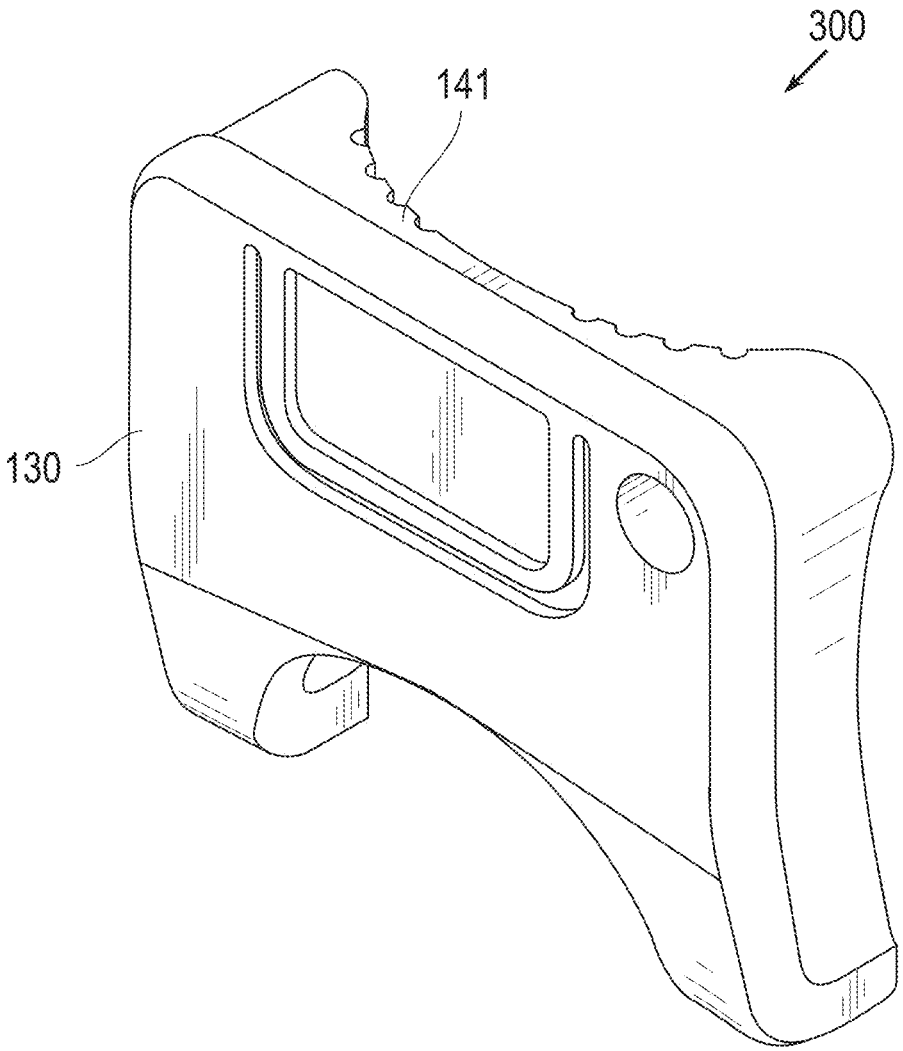
FIG. 7 is a top and side perspective view of an exemplary lap desk in accordance with a second embodiment of the present disclosure.

As shown in FIGS. 3 and 5, the rear 110 includes a rear cutout or opening 111 that accommodates the body (e.g., legs) of the user when the lap desk 100 is placed over the user's lap. The illustrated rear opening 111 has an arcuate shape and defines a first (left) support rail 112 and a second (right) support rail 114 that are parallel to one another and define, in part, the left side 150 and the right side 160, respectively. The rear opening 111 thus also defines a curved underside 113 of the main rear section 170.

As will be appreciated by viewing the drawings, the first support rail 112 and the second support rail 114 extend from the front to the rear of the lap desk and thus, defines also define the lower regions of the first and second arms 180, 190. The distance between these rails 112, 114 is selected to comfortably accommodate the body (e.g., torso) of the user.

It will be appreciated that the arcuate shaped rear opening 111 extends underneath and defines the underside of the main rear section 170 as shown in the figures to accommodate the user's body (e.g., legs) under the entire main rear section 170.

The rear opening 111 can have other shapes other than arcuate, such as rectangular, etc. It will also be appreciated that while the lap desk is shown as having right angle corners and edges, these can alternatively be rounded.

The front section also includes a front opening (cutout) 195 that passes through the front section from the top to the bottom. The front opening 195 defines a front wall 198 that has a curved shape and extends along the inside of the arms 180, 190. The front opening 195 is designed to accommodate the torso of a sitting user and allows the user's torso to get closer to the support or working surface (top 130) of the main rear section 170. The front opening 195 can have any number of different shapes including an arcuate shape as shown. The arcuate shaped front opening 195 defines the first and second arms 180, 190.

The apex of the front opening 195 is generally at the line 105.

The front opening 195 can have other shapes other than arcuate, such as rectangular, etc.

The top surface (top 130) of the front section can be set at angle as illustrated. In other words, the front section can be angled downward relative to the main rear section 170 (See, FIG. 6). This angled surface is flat along its top surface.

The front opening 195 thus extends in a top/down direction and intersects the rear opening 111 that extends in a front/rear direction.

The front 120 is defined by the free ends of the first and second arms 180, 190 and can be defined by flat, planar surfaces.

Accessories

Figure 4:
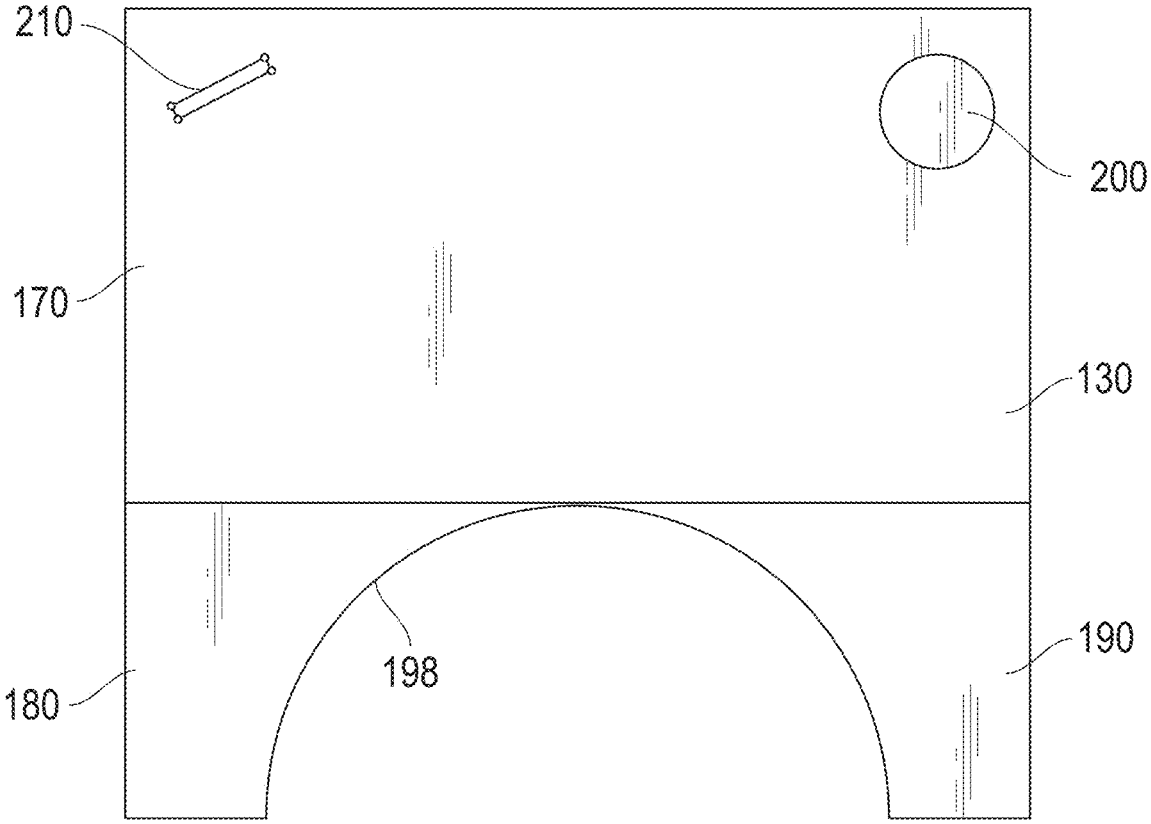
FIG. 4 is a top plan view thereof.

As shown best in FIGS. 1 and 4, the main rear section 170 can include one or more optional accessories. For example, a recessed cup holder 200 can be integrally formed in the body of the lap desk. The cup holder 200 can have any number of shapes and sizes, etc. In addition, the lap desk 100 can include a recessed slot 210 for holding a mobile device, such as a smartphone. These two optional accessories can be located in the two opposite corners of the main rear section or can be located in different locations and can be formed along the same side or edge is desired.

The lap desk 100 can include a protective film or cover or layer (skin) formed along the top 130 to provide enhanced waterproofing, etc. and provide an easy to clean surface. In addition, a fabric layer, such as a synthetic fabric layer, can be provided along the entire top surface, as well as other surfaces. For example, all of the outer surfaces can be fabric covered. In this embodiment, the single block of material, such as foam, can be thought of as being a core and the outer layer is a covering, such as a fabric covering secured to the block. However, it will be appreciated that the product can simply be a single block of material with no covering or skin or separate outer layer (e.g., it can be a single homogenous foam block).

EXAMPLE

The lap desk 100 is formed as a one piece foam lap desk and provides soft and luxurious arm rests in addition to providing a user with a comfortable "hugging sensation" via the horseshoe center geometrical design. The comfort focused geometrical design purposely features an extra-large surface area with enough space for a laptop, mouse, beverage, and cell phone in addition to providing a higher vertical height to keep the laptop closer to your eyes than a typical lap desk. The lap desk 100 provides users with extreme comfort thus giving them the best chance to increase their productivity, since they are not distracted by continuously struggling to find the most comfortable working laptop position.

The interior of the lap desk 100 is made of soft "couch cushion" foam while its exterior can consist of a comfortable and soft fabric with built-in grip strips on the work surface to prevent laptops from sliding around. The lap desk 100 can weigh approximately 3 pounds and the dimensions can be approximately 17"×21"×7".

In addition, the single block of material can include integral ergonomic features, such as channeling, etc., formed during manufacture.

FIGS. 7-10 illustrate a lap desk 300 in accordance with another embodiment. The lap desk 300 is very similar to the lap desk 100 and therefore, like elements are numbered alike. The following discussion focuses on the differences between the two lap desks.

One of the main differences is that the bottom 140 includes cooling channels 141 that are integrally formed in the bottom 140. The cooling channels 141 thus represent channels that are recessed within the body of the lap desk along its bottom 140. As shown, the cooling channels 141 are formed parallel to one another and each extends from the front 120 to the rear 110. One end of each cooling channel 141 is open at the front 120 and the other end of the cooling channel 141 is open at the rear 110. In one embodiment, each cooling channel 141 has a semi-circular shape. Since the bottom 140 is placed in contact or close contact with the lower torso of the user, the cooling channel 141 promotes air flow between the (foam) body of the lap desk 300 and the user's body. This air flow can promote cooling. As shown, the cooling channels 141 are not uniformly spaced across the bottom 140 but can be formed generally in two sets, namely, a first set that is located to the left of the bottom 140 and a second set that is located to the right of the bottom 140. The two sets can be uniform in that each set can contain the same number of channels and within each set, the spacing between the channels can be unform. The lengths of the cooling channels differ but the width can be the same.

Another difference is that first and second support rails 312, 314 of the lap desk 300 have a different construction than the first support rail 112 and the second support rail 114. The first and second support rails 312, 314 define the sides of the lap desk 300 and define the portions that sit on a surface with the user's torso therebetween. The first and second support rails 312, 314 are located radially outside the cooling channels 141. As shown (See, FIG. 9), the first and second support rails 312, 314 can have a stepped construction in that the rear end of the first and second support rails 312, 314 can represent a thickest part of the body. In particular, a small foot 315 can be formed at the rear of each of the first and second support rails 312, 314. The remaining part of the first and second support rails 312, 314 are not as thick and thus there can be a gap or space which can permit air to flow underneath and/or provides a contoured leg. In addition, this increased thickness at the rear can serve to elevate or pitch the lap desk 300.

In addition, in the first embodiment, the first and second arms 180, 190 comprises flat angled surfaces, while in the lap desk 300, the arms 181, 191 are more sloped surfaces.

In addition, a center section of the body of the lap desk 300 can include a handle opening 301 to allow the lap desk 300 to be easily grasped and transported. The handle opening is an elongated structure (e.g., oblong shape) and is formed between the two sets of the cooling channels 141.

Figure 8:
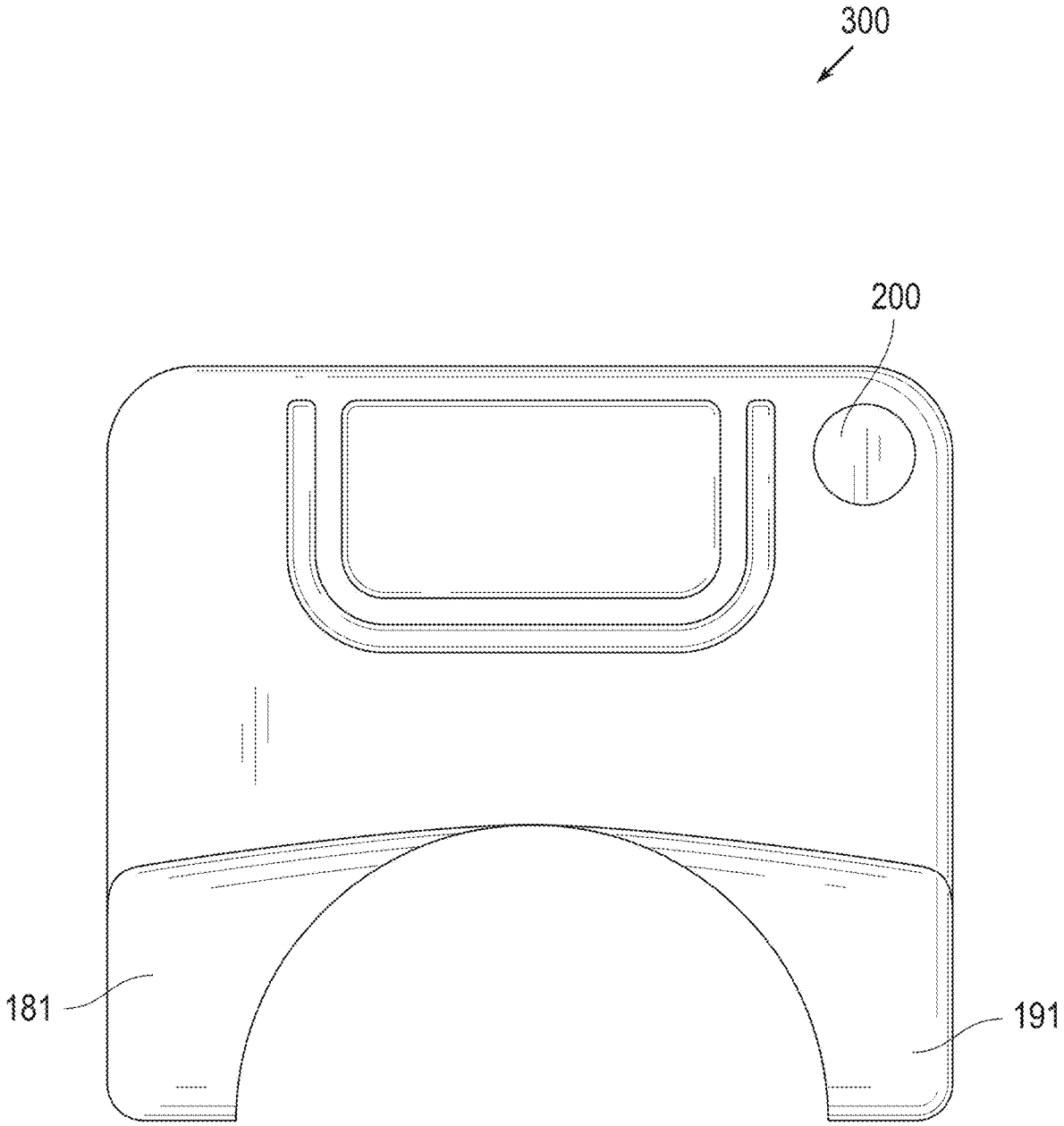
FIG. 8 is a top plan view thereof.
Figure 9:
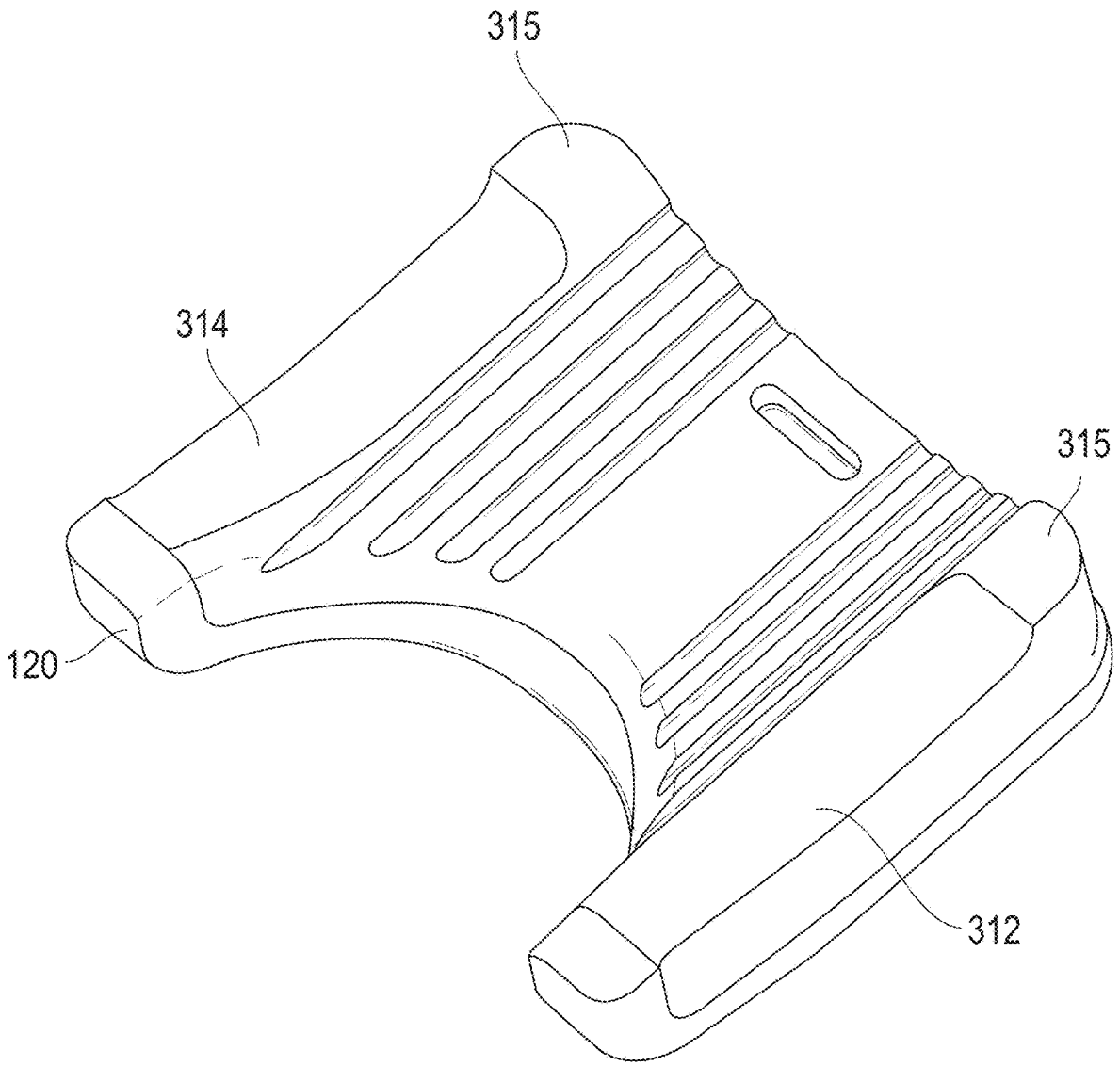
FIG. 9 is a bottom perspective view thereof.
Figure 10:
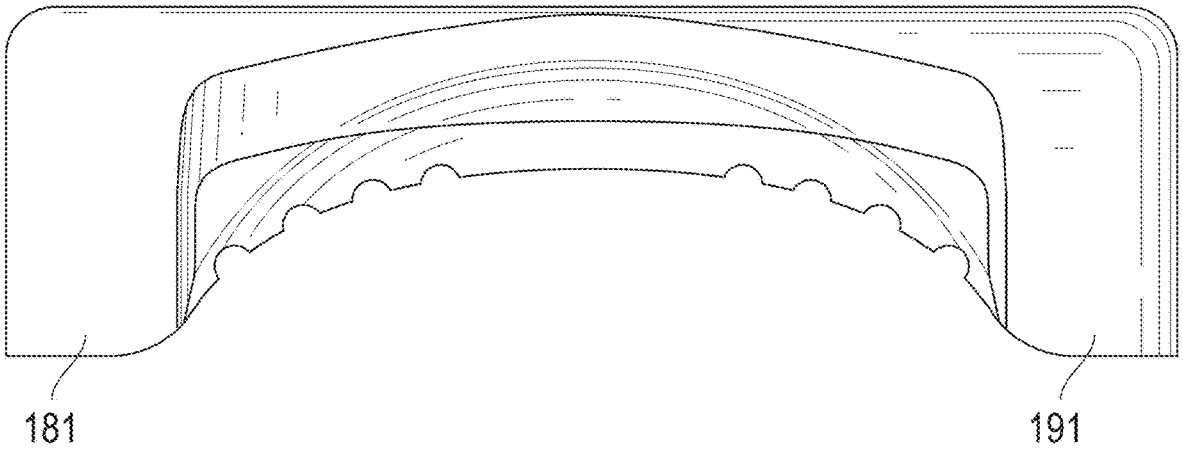
FIG. 10 is a front elevation view thereof.

In addition, as shown in FIG. 8, the center of the rear portion of the lap desk 300 on which an object is placed, such as an electronic device, can include recessed cooling channels. For example, in FIG. 8, a generally square shaped recessed area can be formed with a recessed U-shaped channel formed around the square shaped recessed area. These two recessed areas provide for air cooling passages (ventilation) for the object that is placed over the channels on the flat top surface of the lap desk 300. This feature solves the problem of the object overheating and/or the foam surface getting too hot.

It will also be appreciated that the lap desks disclosed herein provide a hugging effect such that the foam lap desk wraps around a user's midsection which provides for the left and right armrests. In particular, by design, when the user's midsection (torso) is placed inside the U-shaped cutout (opening) the left and right arms are positioned in contact and against the left and right sides of the midsection to allow the user to easily place his/her arms.

It is to be understood that like numerals in the drawings represent like elements through the several figures, and that not all components and/or steps described and illustrated with reference to the figures are required for all embodiments or arrangements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. A lap desk comprising:

a single body formed of foam, the body including a main rear section having a top planar surface and left and right arms that extend forwardly from the main rear section and have top surfaces for supporting arms of a user and are configured to be located alongside opposing sides of a torso of the user;

wherein the single body is constructed such that when the single body rests on a flat ground surface, in an in-use position, the main rear section and the left and right arms are in contact with the ground surface.

2. The lap desk of claim 1, wherein the top planar surface is parallel to the flat ground surface.

3. The lap desk of claim 1, wherein top surfaces of the left and right arms are angled downward from the top planar surface of the main rear section such that the top surfaces of the left and right arms lie in a first plane that is different than a second plane in which the top planar surface of the main rear section lies.

4. The lap desk of claim 1, wherein the single body comprises a molded foam article.

5. The lap desk of claim 4, wherein the foam comprises polyurethane foam.

6. The lap desk of claim 1, wherein single body includes a front U-shaped cutout that defines the left and right arms.

7. The lap desk of claim 6, wherein an apex of the U-shaped cutout is located along a demarcation region that delimits the main rear section from the left and right arms and defines a transition from the first plane to the second plane.

8. The lap desk of claim 1, wherein the main rear section has an arcuate shaped open that is open at a front of the single body and is defined by a curved underside of the main rear section.

9. The lap desk of claim 1, wherein the main rear section includes a recessed cup holder and a recessed slot for receiving a mobile device.

10. The lap desk of claim 1, wherein the single body formed of foam has a bottom surface, the bottom surface having a plurality of open cooling channels formed therein.

11. The lap desk of claim 10, wherein each open cooling channel has a semi-circular shape and is open along the bottom surface.

12. The lap desk of claim 10, wherein the plurality open cooling channels are parallel to one another and each extends from a rear edge of the single body to a front edge of the single body.

13. The lap desk of claim 10, wherein the plurality of open cooling channels have different lengths.

14. The lap desk of claim 10, wherein the plurality of open cooling channels are arranged in a first set and a second set with a center section of the bottom surface being devoid of the open cooling channels.

15. The lap desk of claim 1, wherein an underside of each of the first and second arms has a stepped construction.

16. A lap desk comprising:

a rear section having a top planar surface; and a forward section that includes shaped opening for receiving a torso of a user, the shaped opening defining left and right arms that extend forwardly from the rear section and have top surfaces for supporting arms of a user due to the left and right arms configured for placement against left and right sides of the torso of the user resulting in the lap desk wrapping around the torso, the top surfaces of the left and right arms being spaced from and distinct from the top planar surface for allowing the arms of the user to be placed and supported by the left and right arms without placement on the top planar surface of the rear section;

wherein the lap desk is formed as a single block of foam material;

wherein the shaped opening is U-shaped and wherein outer walls of the left and right arms are coaxial and coplanar with outer walls of the rear section, wherein an apex of the U-shaped opening is located along a demarcation region that delimits the rear section from the left and right arms and defines a transition from a first plane in which the entire rear section lies to a second plane in which the top surfaces of the left and right arms lie, the second plane being at an angle less than 90 degrees relative to the first plane.

17. The lap desk of claim 16, wherein top surfaces of the left and right arms are sloped or beveled and lie in a plane that is below a horizontal plane that contains the top planar surface of the rear section.

18. A lap desk comprising:

a single body formed of foam, the body including a main rear section having a top planar surface and left and right arms that extend forwardly from the main rear section and have top surfaces for supporting arms of a user and are configured to be located alongside opposing sides of a torso of the user;

wherein the left arm is defined by a left inner surface and a left outer surface and the right arm is defined by a right inner surface and a right outer surface, wherein at least a section of the left inner surface is parallel to at least a section of the right inner surface and wherein at least a section of the left outer surface is parallel to at least a section of the right outer surface.

19. A lap desk comprising:

a single body formed of foam, the body including a main rear section having a top planar surface and left and right arms that extend forwardly from the main rear section and have top surfaces for supporting arms of a user and are configured to be located alongside opposing sides of a torso of the user;

wherein the top planar surface of the main rear section is parallel to a bottom surface of the body.

20. A lap desk comprising:

a single body formed of foam, the body including a main rear section having a top planar surface and left and right arms that extend forwardly from the main rear section and have top surfaces for supporting arms of a user and are configured to be located alongside opposing sides of a torso of the user;

wherein the single body is constructed such that when the single body rests on a flat ground surface, in an in-use position, ground contacting bottom surfaces of the main rear section and the left and right arms are coplanar.

* * * * *